US008887545B2

(12) United States Patent
Ito et al.

(10) Patent No.: US 8,887,545 B2
(45) Date of Patent: Nov. 18, 2014

(54) FORGING DIE HOLDER

(75) Inventors: Masami Ito, Inabe (JP); Masanori Tanahashi, Inabe (JP); Hiroyuki Nakanishi, Inabe (JP)

(73) Assignee: Kobe Steel, Ltd., Kobe-shi (JP)

( * ) Notice: Subject to any disclaimer, the term of this patent is extended or adjusted under 35 U.S.C. 154(b) by 849 days.

(21) Appl. No.: 13/077,038

(22) Filed: Mar. 31, 2011

(65) Prior Publication Data

US 2011/0259074 A1 Oct. 27, 2011

(30) Foreign Application Priority Data

Apr. 27, 2010 (JP) ..... 2010-101798

(51) Int. Cl.
*B21J 1/06* (2006.01)
*B21K 29/00* (2006.01)
*B21J 13/03* (2006.01)

(52) U.S. Cl.
CPC ... *B21J 13/03* (2013.01); *B21J 1/06* (2013.01)
USPC ..... 72/342.7; 72/342.1; 72/342.92

(58) Field of Classification Search
CPC ..... B21D 37/16; B21J 1/06; B21K 29/00
USPC ..... 72/57, 60, 342.1, 342.7, 342.8, 347, 72/350, 360, 342.5, 342.92, 342.96
See application file for complete search history.

(56) References Cited

U.S. PATENT DOCUMENTS 2,814,101 A * 11/1957 Prough et al. ..... 72/342.8
3,007,427 A * 11/1961 Wheelon et al. ..... 72/63
3,440,858 A * 4/1969 Motley et al. ..... 83/38
3,703,093 A * 11/1972 Komatsu et al. ..... 72/342.4
7,112,249 B2 * 9/2006 Schroth et al. ..... 148/511
7,159,437 B2 * 1/2007 Schroth et al. ..... 72/342.8
8,230,713 B2 * 7/2012 Krajewski et al. ..... 72/342.7

FOREIGN PATENT DOCUMENTS

JP 51-157554 U 12/1976
JP 59-89636 U 6/1984
JP 2-160136 A * 6/1990 ..... B21J 13/02
JP 2-303647 A * 12/1990 ..... B21J 13/02
JP 3-77741 A 4/1991
JP 8-206768 8/1996
JP 11-33663 A 2/1999
JP 2002-96134 4/2002

OTHER PUBLICATIONS

Combined Chinese Office Action and Search Report Issued May 6, 2013 in Patent Application No. 201110104378.2 (with English translation and English translation of Categories of Cited Documents).

* cited by examiner

*Primary Examiner* — Edward Tolan
(74) *Attorney, Agent, or Firm* — Oblon, Spivak, McClelland, Maier & Neustadt, L.L.P.

(57) ABSTRACT

There is provided a forging die holder including a resistance heater capable of efficiently heating a die via the die holder when warm forging or hot forging is performed. A die holder is for holding a die used in a forging press for performing warm forging or hot forging. The die holder has heater mounting holes into which resistance heaters are inserted, sensor mounting holes into which temperature sensors are inserted, and guide portions disposed on both end portions of holder surfaces of holders for supporting back surfaces of the foregoing die to support side surfaces of the foregoing die located therebetween on both sides thereof. The heater mounting holes are formed at positions opposing the holder surfaces in aligned relation with the side surfaces of the foregoing die.

8 Claims, 6 Drawing Sheets

FORGING DIE HOLDER

FIELD OF THE INVENTION

The present invention relates to a forging die holder used to hold a die when a forging raw material is subjected to warm forging or hot forging using a forging press.

BACKGROUND OF THE INVENTION

Conventionally, when a forging raw material in a preheated state is subjected to warm forging or hot forging using a forging press, forging is performed by preheating forging dies and also a forging die holder holding the dies so as not to degrade the plastic deformability of the forging raw material (see, e.g., Japanese Unexamined Patent Application Publication No. Hei 08 (1996)-206768 (FIGS. 1, 2A, and 2B)).

In the forging die holder described in Japanese Unexamined Patent Application Publication No. Hei 08 (1996)-206768 (FIGS. 1, 2A, and 2B) mentioned above, a plurality of parallel grooves each having a U-shaped cross-sectional shape are formed in the longitudinal side surfaces of the die holder, and resistance heaters (sheathed heaters) each formed of a resistance heating element are inserted into the grooves, and covered with a heat insulator material. In the longitudinal side surfaces of the die holder, in the vicinity of the resistance heaters (heaters), a plurality of temperature sensors are disposed along the resistance heaters.

To the lateral side surface of the die holder described in Japanese Unexamined Patent Application Publication No. Hei 08 (1996)-206768 (FIGS. 1, 2A, and 2B), a receptacle box including a lid open/close sensor is attached. In the forging die holder, the resistance heaters and the temperature sensors are provided in the side surfaces of the die holder so that a heating device controls the temperature of heating performed with the resistance heaters based on measurement data by the temperature sensors.

SUMMARY OF THE INVENTION

In the heating device for the die holder described in Japanese Unexamined Patent Application Publication No. Hei 08 (1996)-206768 (FIGS. 1, 2A, and 2B), in order to prevent a press load placed by the forging press on the forging raw material that has been set in the dies from being applied to the resistance heaters and the temperature sensors, the resistance heaters and the temperature sensors are disposed on the both longitudinal surfaces which are at positions most distant from the dies disposed in the middle portion of the die holder.

This can reduce the foregoing press load placed on the resistance heaters but, due to the distance by which the resistance heaters are apart from the dies, heat generated from the resistance heaters is less readily and more slowly transmitted to the dies in the middle portion of the die holder. As a result, a problem arises that the resistance heaters cannot efficiently heat the dies to predetermined temperatures via the die holder to perform preheating or heat retention.

Even if the temperature sensors can detect the temperatures of the heated portions of the die holder heated with the resistance heaters, since the temperature measurement is performed at the positions apart from the dies in the middle portion of the die holder, a problem also arises that the preheated temperatures of the dies before warm forging or hot forging is performed and the temperatures at which the dies are held during forging cannot be accurately measured.

The present invention has been achieved in view of the foregoing problems, and an object of the present invention is to provide a forging die holder including resistance heaters capable of efficiently heating a die via the die holder when warm forging or hot forging is performed.

To solve the foregoing problems, the forging die holder according to a first aspect of the present invention is a forging die holder for holding a die used in a forging press for performing warm forging or hot forging, including: a heater mounting hole into which a resistance heater is inserted; a sensor mounting hole into which a temperature sensor is inserted; and guide portions disposed on both end portions of a holder surface of the holder for supporting a back surface of the foregoing die to support side surfaces of the foregoing die located therebetween on both sides thereof, wherein the foregoing heater mounting hole is formed at a position opposing the foregoing holder surface in aligned relation with the side surfaces of the foregoing die.

Here, the "position opposing the holder surface" indicates a "position in a range in which the heater mounting hole and the holder surface on which the die having the back surface thereof supported thereon and the pair of guide portions supporting the die located therebetween on both sides thereof are disposed to face each other".

The wording "is formed in aligned relation with the side surfaces of the die" does not mean "being completely parallel with the side surfaces of the die" but includes "something formed substantially along the directions of the side surfaces of the die".

In such an arrangement of the forging die holder, even when a press load is placed on the resistance heater during forging, the heater mounting hole is formed at the position opposing the holder surface for supporting the back surface of the die in aligned relation with the side surfaces of the die. Accordingly, the resistance heater is disposed at a position laterally displaced from positions vertically over and under a forging raw material in the die. Therefore, the forging die holder allows efficient heating of the die at a position where the press load is unlikely to be placed on the resistance heater using the resistance heater inserted in the heater mounting hole.

As a result, the forging die holder performs temperature measurement using the temperature sensor, while holding the die between the guide portions on the both end portions, and heats the die using the resistance heater in the vicinity of the die to allow the die to be preheated to an appropriate temperature or maintained in a state at an appropriate temperature.

The forging die holder according to a second aspect of the present invention is the forging die holder according to the first aspect of the present invention, wherein, on the foregoing holder surface, a plurality of the foregoing dies are juxtaposed, and the foregoing heater mounting hole is formed at a position between the foregoing plurality of dies in aligned relation with each of the side surfaces of the foregoing plurality of dies.

In such an arrangement of the forging die holder, the heater mounting hole is formed at the position between the plurality of dies in aligned relation with each of the side surfaces of the plurality of dies. Therefore, using the resistance heater inserted into the heater mounting hole, it is possible to efficiently heat each of the dies at a proximate position.

The forging die holder according to a third aspect of the present invention is the forging die holder according to the first or second aspect of the present invention, wherein the foregoing heater mounting hole is formed to extend from a front surface of the foregoing die holder to a rear surface thereof, and the foregoing resistance heater is formed of a rod-like heater removably provided to extend in the foregoing heater mounting hole.

In such an arrangement of the forging die holder, the heater mounting hole is formed to extend from the front surface of the die holder to the rear surface thereof. Therefore, using the resistance heater formed of the rod-like heater provided in the heater mounting hole, it is possible to swiftly heat the whole die.

The forging die holder according to a fourth aspect of the present invention is the forging die holder according to any one of the first to third aspects of the present invention, wherein the foregoing resistance heater is formed of a multi-cell heater in which a plurality of heaters are connected in a longitudinal direction.

In such an arrangement of the forging die holder, the resistance heater is formed of the multi-cell heater in which the plurality of heaters are connected in the longitudinal direction. This allows the die holder to be divided into parts corresponding in number to the heaters, and allows the die to be heated to appropriate temperatures suited to the individual portions of the die.

The forging die holder according to a fifth aspect of the present invention is the forging die holder according to any one of the first to fourth aspects of the present invention, wherein a plurality of the foregoing heater mounting holes are arranged in a vertical direction, and the foregoing resistance heater is inserted in each of the plurality of heater mounting holes.

In such an arrangement of the forging die holder, the plurality of heater mounting holes are arranged in the vertical direction. As a result, it is possible to swiftly heat the whole die holder with the plurality of resistance heaters individually inserted in the heater mounting holes.

The forging die holder according to a sixth aspect of the present invention is the forging die holder according to the fifth aspect of the present invention, wherein the foregoing sensor mounting hole is disposed generally in the middle of the foregoing plurality of provided heater mounting holes.

In such an arrangement of the forging die holder, the sensor mounting hole is disposed generally in the middle of the plurality of heater mounting holes. This allows the temperature at the middle of a portion heated with the plurality of resistance heaters to be measured with the one temperature sensor inserted in the one sensor mounting hole.

The forging die holder according to a seventh aspect of the present invention is the forging die holder according to the fifth or sixth aspect of the present invention, wherein the foregoing die holder is formed with a lateral groove orthogonal to the foregoing plurality of heater mounting holes, the foregoing plurality of resistance heaters are provided with respective lead wires, and each of the foregoing lead wires is led to the outside of the foregoing die holder via the foregoing lateral groove, and wired.

In such an arrangement of the forging die holder, the respective lead wires of the plurality of resistance heaters are led to the outside of the die holder via the lateral groove orthogonal to the plurality of heater mounting holes, and wired. This allows the individual lead wires to be easily routed into a bundled state.

In the forging die holder according to the first aspect of the present invention, the heater mounting hole is formed at the position opposing the holder surface in aligned relation with the side surfaces of the die. As a result, when warm forging or hot forging is performed with the forging press, it is possible to reduce the press load which is placed on the forging raw material and also on the resistance heater, and prevent damage to or failure in the resistance heater. Additionally, with heat generated from the resistance heater at the position proximate to the die closer to the middle portion of the holder surface, the die can be efficiently heated to be preheated to an appropriate temperature or maintained in a state at an appropriate temperature.

In the forging die holder according to the second aspect of the present invention, the heater mounting hole is formed at the position between the plurality of dies in aligned relation with the side surfaces of each of dies. This allows the resistance heater to be disposed at a position in the vicinity of each of the dies. Accordingly, due to the distance by which the resistance heater is disposed closer to each of the dies, each of the dies can be preheated more swiftly to a predetermined temperature appropriate for performing warm forging or hot forging and held at the temperature.

In the forging die holder according to the third aspect of the present invention, the resistance heater formed of the rod-like heater is inserted into the heater mounting hole formed to extend from the front surface of the die holder to the rear surface thereof. This allows the whole die to be efficiently heated.

In the forging die holder according to the fourth aspect of the present invention, the resistance heater is formed of the rod-like multi-cell heater in which the plurality of heaters are connected in the longitudinal direction. This allows the die to be heated to desired temperatures suited to the individual portions of the die. As a result, it is possible to preheat or heat the whole die to an optimum temperature for performing warm forging or hot forging.

In the forging die holder according to the fifth aspect of the present invention, by inserting the resistance heaters into the plurality of heater mounting holes arranged in the vertical direction, the whole die holder can be swiftly heated to be able to efficiently preheat the die held in the die holder or retain the temperature thereof.

In the forging die holder according to the sixth aspect of the present invention, the sensor mounting hole is disposed generally in the middle of the plurality of resistance heaters. This allows the temperature at the middle of the portion heated with the plurality of resistance heaters to be measured. Therefore, the temperature of the die can be accurately measured. As a result, the heated temperature or the preheated temperature can be efficiently and accurately measured even with the one temperature sensor disposed at the middle. In addition, since the number of the temperature sensors is small, the number of assembly steps and the number of parts can be reduced.

In the forging die holder according to the seventh aspect of the present invention, the lead wires of the plurality of resistance heaters can be routed in the bundled state. Therefore, a wiring operation for the resistance heaters can be simplified.

DETAILED DESCRIPTION OF THE PREFERRED EMBODIMENTS

Figure 1:
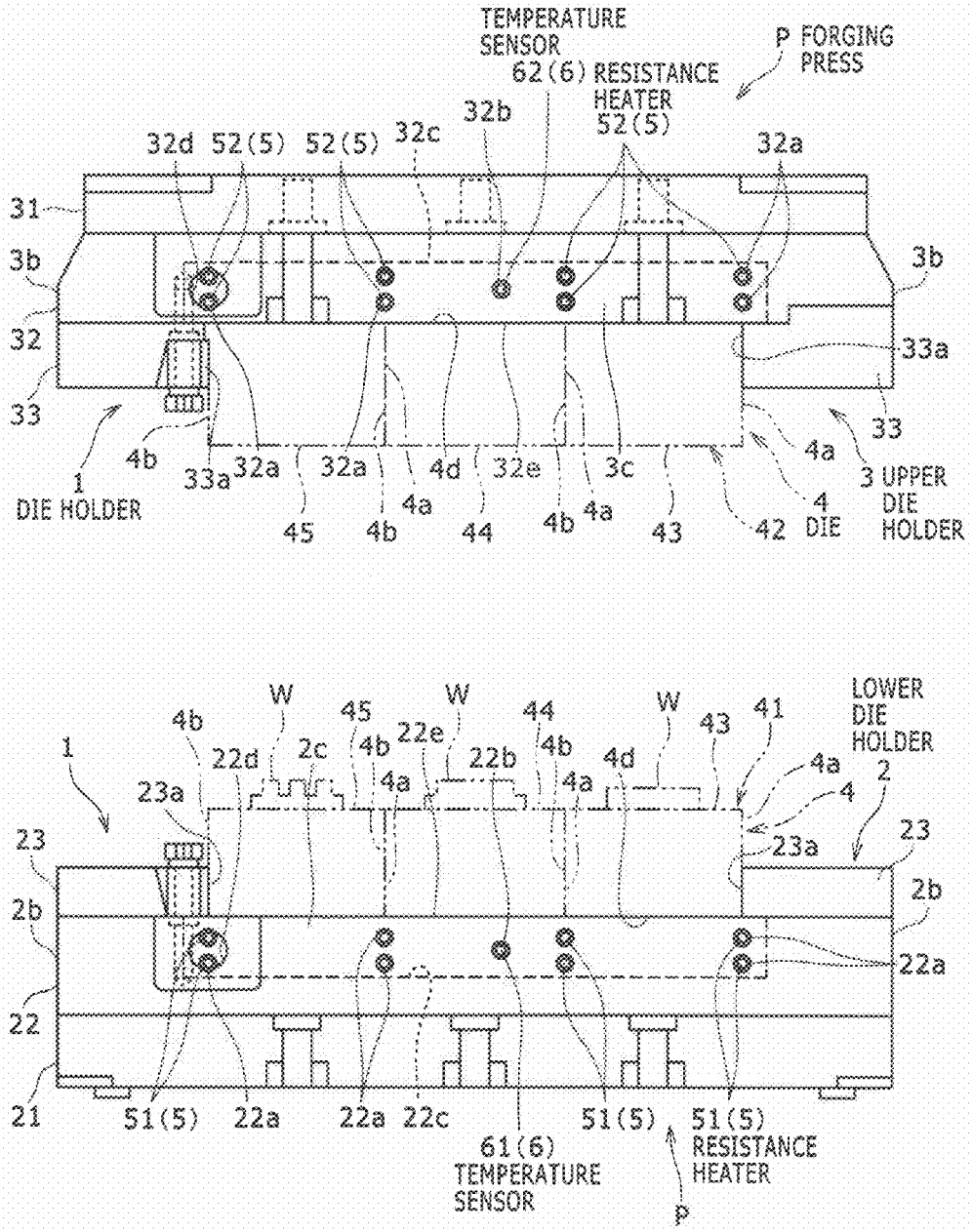
FIG. 1 is a front view showing a forging die holder according to an embodiment of the present invention.

Referring now to the drawings, an embodiment for practicing the invention will be described hereinbelow.

Note that the direction in which a die holder 1 (forging die holder) is installed and the direction in which the die holder 1 is driven can be changed as necessary by changing the directions in which a lower die 41 and an upper die 42 of a forging press P shown in FIG. 1 and the like are installed, but a description will be given by using, as an example, the case where the upper die 42 moves in a vertical direction and assuming that a front-to-rear direction and a left-to-right direction in the drawings correspond to the vertical direction and a lateral direction for the sake of convenience.

Prior to the description of the die holder 1, the forging press P to which the die holder 1 is attached and a die 4 held by the die holder 1 will be described.

<<Structure of Forging Press>>

As shown in FIG. 1, the forging press P is a vertical multi-step forging pressing machine (forging die apparatus) in which, e.g., a forging raw material W is finished through warm forging or hot forging performed in multiple steps using busting step dies 43, blocking step dies 44, and finishing step dies 45. For example, the forging press P operates by hydraulic pressure or the like. The forging press P includes the die 4 for pressure forming the forging raw material W, the die holder 1 for holding the die 4, and an elevator (not shown) for upwardly and downwardly moving the upper die 42.

<<Structure of Die>>

The die 4 is a forging die used in the forging press P. The die 4 is comprised of the lower die 41 for supporting the forging raw material W from below to form the lower surface side and the upper die 42 for compressing the forging raw material W by applying a pressing force thereto from above to form the upper surface side. Each of the lower die 41 and the upper die 42 includes three forging dies which are, e.g., the busting step die 43 for performing a busting step of crushing the forging raw material W, the blocking step die 44 for performing a blocking step performed after the busting step, and the finishing step die 45 for performing a finishing step of finally finishing the forging raw material W.

The die 4 has left and right side surfaces 4*a* and 4*b* which are interposed between the supporting surfaces 23*a* and 33*a* of lower guide portions 23 and upper guide portions 33 to be supported thereby in an in-between state, and disposed at positions closer to the middle portion of the die holder 1 than to the outer wall surfaces thereof.

<Structure of Lower Die>

As shown in FIG. 1, the lower die 41 is a lower surface forming die in which the forging raw material W is placed at the time of forging, and the lower surface side of the forging raw material W is formed. The busting step die 43, the blocking step die 44, and the finishing step die 45 of the lower die 41 are horizontally juxtaposed in the left-to-right direction and, in that state, they are connected to the lower die holder 2 by, e.g., bolting.

<Structure of Upper Die>

The upper die 42 is an upper surface forming die which presses and forms the upper surface side of the forging raw material W when downwardly moved by the elevator (not shown). The busting step die 43, the blocking step die 44, and the finishing step die 45 of the upper die 42 are horizontally juxtaposed in the left-to-right direction and, in that state, they are connected to the upper die holder 3 by, e.g., bolting.

<<Structure of Die Holder>>

Figure 2:
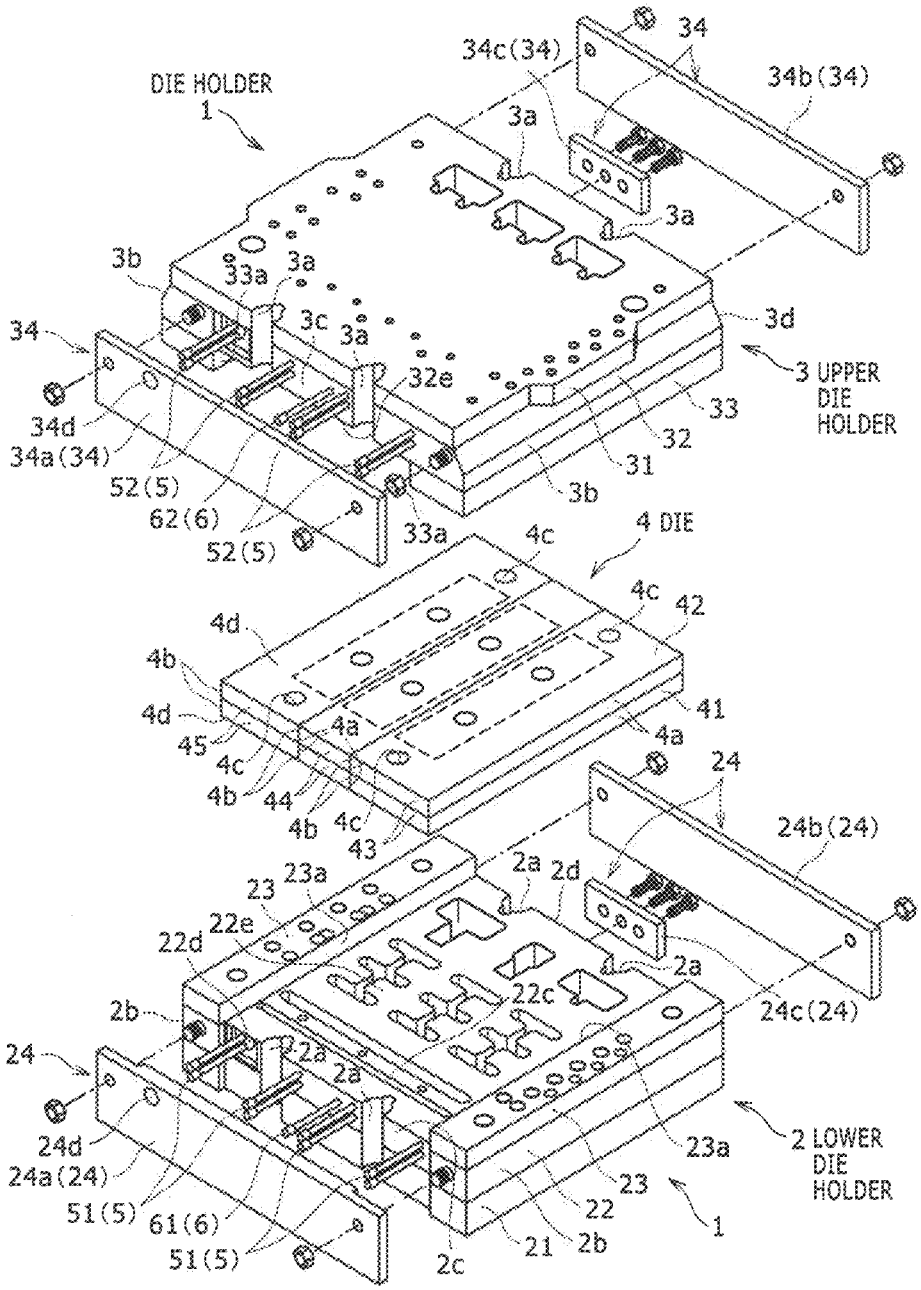
FIG. 2 is a schematic perspective view showing the state of mounting of resistance heaters and temperature sensors which are mounted in the forging die holder according to the embodiment of the present invention.

The die holder 1 is a tool for holding and fixing the die 4 to the forging press P. As shown in FIGS. 1 and 2, the die holder 1 includes a lower die holder 2 for holding the lower die 41, an upper die holder 3 for holding the upper die 42, resistance heaters 5 for heating the die 4 via the die holder 1, temperature sensors 6 for measuring the temperature of the die holder 1, and cover members 24 and 34 for closing heater mounting holes 22*a* and 32*a* and sensor mounting holes 22*b* and 32*b* which are formed in the die holder 1 and in which the resistance heaters 5 and the temperature sensors 6 are inserted. In the die holder 1, a plurality of the dies 4 are disposed by being horizontally arranged in a lateral row.

FIG. 2 is a schematic perspective view of the forging die holder according to the embodiment of the present invention, which is a schematic view showing the state when the resistance heaters and the temperature sensors are slightly pulled out of the heater mounting holes and the sensor mounting holes, and lead wires connected to the resistance heaters and the temperature sensors are omitted.

<<Structure of Lower Die Holder>>

As shown in FIG. 2, the lower die holder 2 is a member set on the base table (not shown) of the forging press P to hold the lower die 41. The lower die holder 2 includes a lower main die holder 21 fixedly mounted on the foregoing base table, a lower sub die holder 22 attached onto the lower main die holder 21, the pair of lower guide portions 23 attached onto the left and right parts of the lower sub die holder 22, resistance heaters 51 which are those of the foregoing resistance heaters 5 mounted in the lower die holder 2, a temperature sensor 61 which is the one of the foregoing temperature sensors 6 mounted in the lower die holder 2, a front cover 24*a* attached to the front surface 2*c* of the lower die holder 2, and a rear cover 24*b* and a lid plate 24*c* each attached to the rear surface 2*d* of the lower die holder 2.

<<Structure of Upper Die Holder>>

The upper die holder 3 is a member set under the press portion (not shown) of the forging press P to hold the upper die 42. The upper die holder 3 includes an upper main die holder 31 fixed to the lower portion of the foregoing press portion, an upper sub die holder 32 attached to the lower surface of the upper main die holder 31, the pair of upper guide portions 33 attached to the left and right parts of the upper sub die holder 32, resistance heaters 52 which are those of the foregoing resistance heaters 5 mounted in the upper die holder 3, a temperature sensor 61 which is the one of the foregoing temperature sensors 6 mounted in the upper die holder 3, a front cover 34*a* attached to the front surface 3*c* of the upper die holder 3, and a rear cover 34*b* and a lid plate 34*c* each attached to the rear surface 3*d* of the upper die holder 3.

That is, the upper die holder 3 and the foregoing lower die holder 2 are a pair of upper and lower die holders disposed generally symmetrically to form the die holder 1. Hereinbelow, the upper die holder 3 and the foregoing lower die holder 2 are collectively described.

<<Structures of Lower Main Die Holder and Upper Main Die Holder>>

The lower main die holder 21 is a member for movably fixing the lower die holder 2 to the base table (not shown). Onto the lower main die holder 21, the lower sub die holder 22 is removably attached.

The upper main die holder 31 is a member slidably attached to the press portion of the elevator not shown to allow upward and downward movement of the upper die holder 3. To the lower surface of the upper main die holder 31, the upper sub die holder 32 is removably attached.

<<Structures of Lower Sub Die Holder and Upper Sub Die Holder>>

As shown in FIG. 1, the lower sub die holder 22 (holder) is a member for holding the lower die 41 fixedly mounted thereon. On the middle portion of a holder surface 22*e*, the lower die 41 is disposed while, to the both left and right end portions 2*b* of the holder surface 22*e*, the pair of lower guide portions 23 are attached.

The upper sub die holder 32 (holder) is a member for holding the upper die 42 from above. On the middle portion of a holder surface 32*e*, the upper die 42 is disposed while, to the both left and right end portions 3*b* of the holder 32*e*, the pair of upper guide portions 33 are attached.

The lower sub die holder 22 and the upper sub die holder 32 are formed with the heater mounting holes 22*a* and 32*a* into which the plurality of resistance heaters 5 are individually inserted, the sensor mounting holes 22*b* and 32*b* into which the temperature sensors 6 are inserted, lateral grooves 22*c* and 32*c* in which lead wires 5*e* and 6*a* (see FIGS. 3, 4, and 7) of the resistance heaters 5 and the temperature sensors 6 are routed, lead-out holes 22*d* and 32*d* for leading the respective lead wires 5*e* and 6*a* (see FIGS. 3, 4, and 7) in bundled states to the outside of the lower sub die holder 22 and the upper sub die holder 32, and the holder surfaces 22*e* and 32*e* for supporting the respective back surfaces 4*d* of the lower die 41 and the upper die 42.

<Structures of Heater Mounting Holes>

Figure 3:
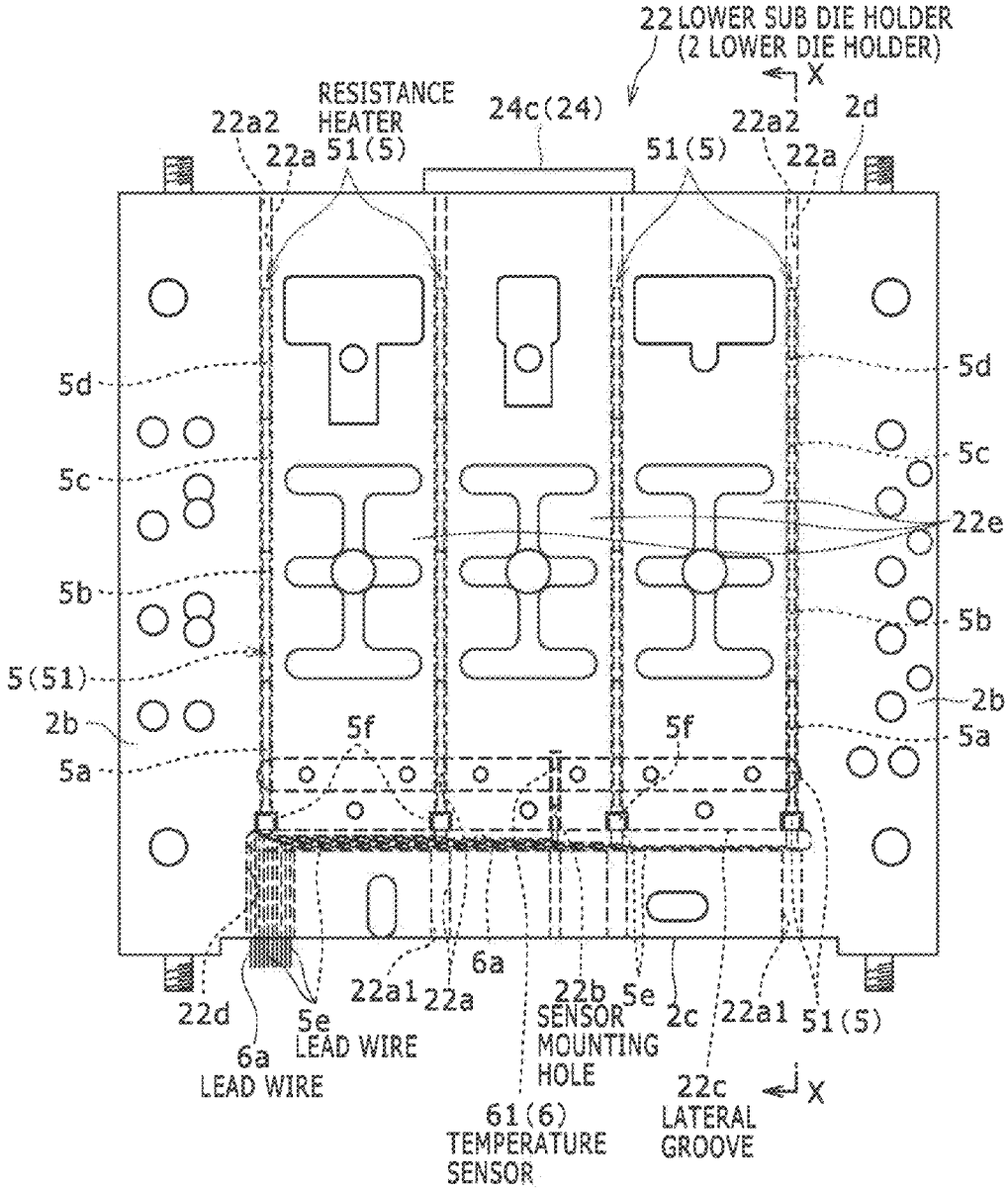
FIG. 3 is a plan view of a lower sub die holder of the forging die holder according to the embodiment of the present invention.
Figure 4:
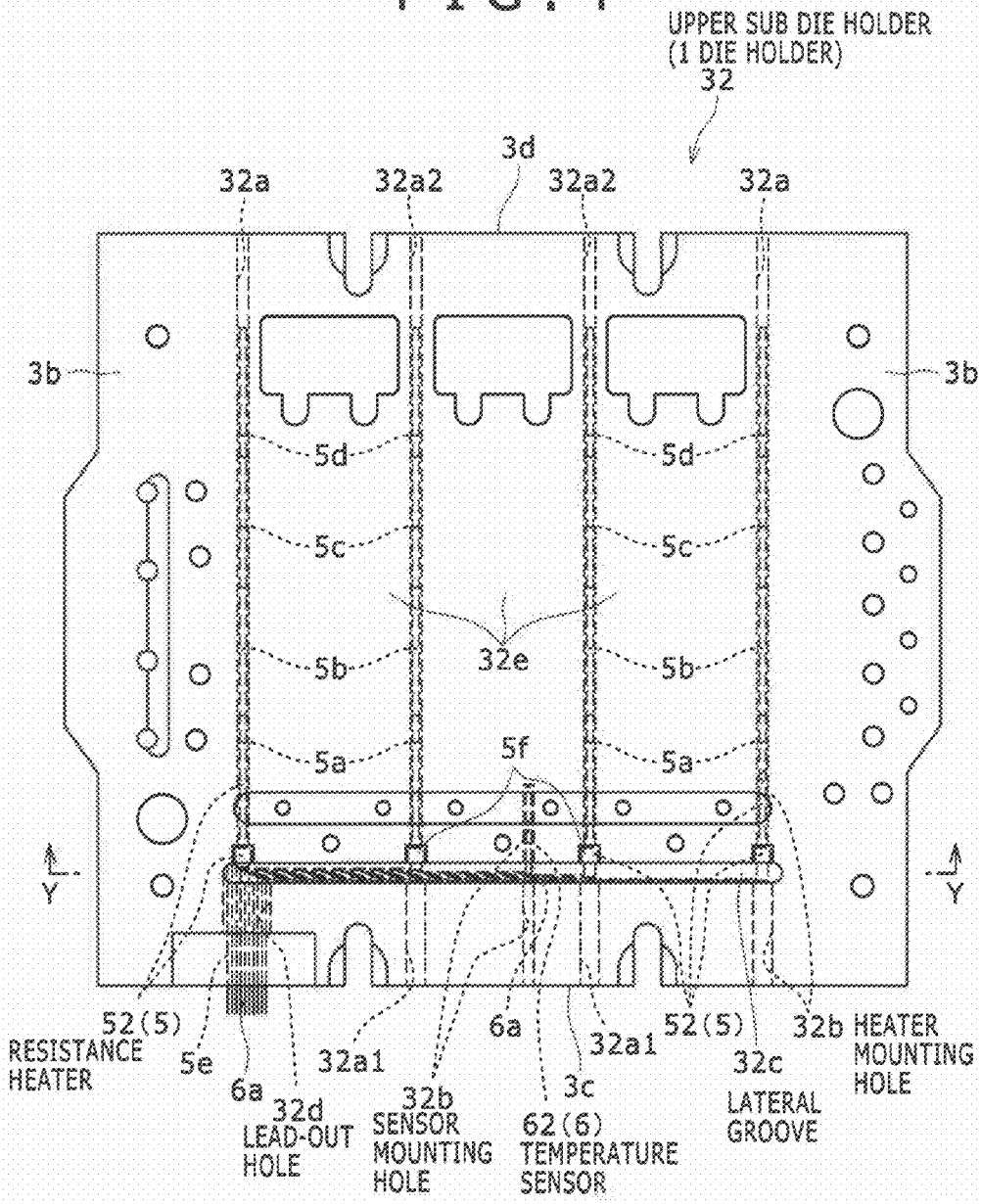
FIG. 4 is a bottom view of an upper sub die holder of the forging die holder according to the embodiment of the present invention.
Figure 5:
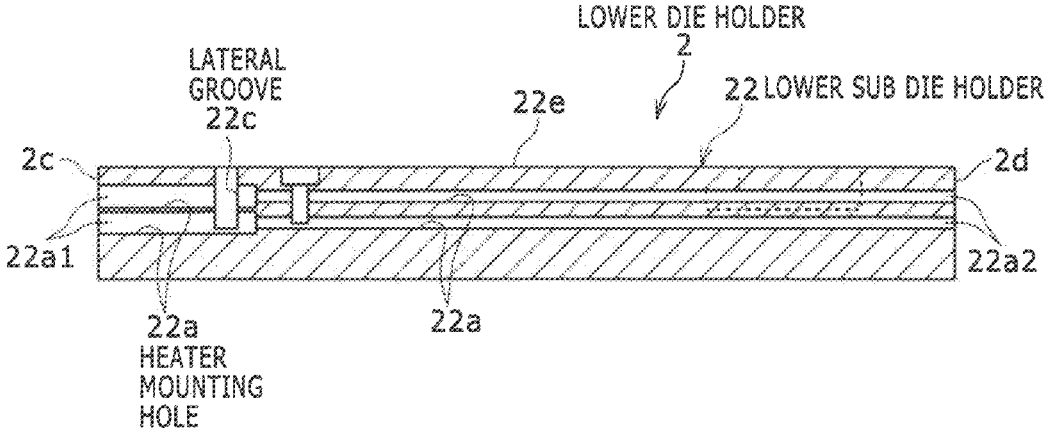
FIG. 5 is a cross-sectional view along the line X-X of FIG. 3.
Figure 6:
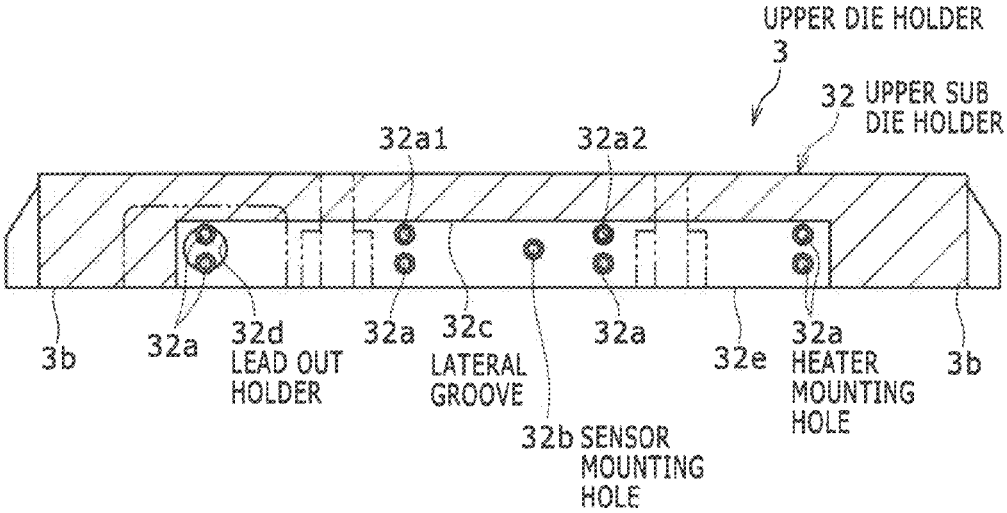
FIG. 6 is a cross-sectional view along the line Y-Y of FIG. 4.

As shown in FIG. 3 or FIG. 4, the heater mounting holes 22*a* and 32*a* are long holes into which the resistance heaters 51 and 52 each in the form of an elongated rod are removably inserted. The heater mounting holes 22*a* and 32*a* are formed to horizontally extend through the lower die holder 2 and the upper die holder 3 from the front surfaces 2*c* and 3*c* thereof to the rear surfaces 2*d* and 3*d* thereof. The heater mounting holes 22*a* and 32*a* are formed in the lower sub die holder 22 and the upper die holder 32 along the left and right side surfaces thereof to be located vertically over and under the left and right side surfaces of the busting step dies 43, the blocking step dies 44, and the finishing step dies 45 that are set in the lower die holder 2 and the upper die holder 3.

In other words, the heater mounting holes 22*a* and 32*a* are formed at positions opposing the holder surfaces 22*e* and 32*e* over and under the side surfaces 4*a* and 4*b* of the individual dies 4 in vertically aligned relation therewith in the lower sub die holder 22 and the upper sub die holder 32 (holders). The heater mounting holes 22*a* and 32*a* are arranged in pairs such that each pair of the two (plurality of) heater mounting holes 22*a* or 32*a* are vertically aligned to extend between the adjacent two of the plurality of dies 4 along the longitudinal direction of the dies 4 when viewed in plan view. The resistance heaters 5 are individually inserted into the respective heater mounting holes 22*a* and 32*a*.

That is, as shown in FIG. 1, when viewed in front view, in alignment with the respective positions of the left and right side surfaces of the busting step dies 43, the blocking step dies 44, and the finishing step dies 45 and in each of the front surfaces of the lower sub die holder 22 and the upper sub die holder 32, the heater mounting holes 22*a* and 32*a* are arranged in lateral two rows each including the four holes and vertical four columns each including the two holes and spaced apart at intervals corresponding to the widths of the three dies 4.

As shown in FIG. 3 or 4, the heater mounting holes 22*a* and 32*a* are comprised of larger-diameter portions 22*a*1 and 32*a*1 into which the pole discs 5*f* of the resistance heaters 51 and 52 are inserted and smaller-diameter portions 22*a*2 and 32*a*2 into which heaters 5*a* to 5*d* are inserted, which are formed in continued relation. The larger-diameter portions 22*a*1 and 32*a*1 of the heater mounting holes 22*a* and 32*a* closer to the front surfaces 2*c* and 3*c* of the lower sub die holder 22 and the upper sub die holder 32 into which the resistance heaters 51 and 52 are inserted are formed to have larger diameters in accordance with the diameters of the pole discs 5*f* of the resistance heaters 51 and 52. The smaller-diameter portions 22*a*2 and 32*a*2 closer to the rear surfaces 2*d* and 3*d* into which the heaters 5*a* to 5*d* of the resistance heaters 51 and 52 are inserted are formed to have smaller diameters which are larger by about 2 to 3 mm than the diameters of the heaters 5*a* to 5*d* such that the resistance heaters 51 and 52 are replaceable (removable).

<Structures of Sensor Mounting Holes>

The sensor mounting holes 22*b* and 32*b* are for allowing the temperature sensors 61 and 62 each in the form of an elongated rod to be removably inserted thereinto. The sensor mounting holes 22*b* and 32*b* are bottomed cylindrical holes formed to horizontally extend from the front surfaces 2*c* and 3*c* of the lower die holder 2 and the upper die holder 3 toward the rear surfaces 2*d* and 3*d* thereof. The sensor mounting holes 22*b* and 32*b* are disposed generally in the middle of the plurality of heater mounting holes 22*a* and 32*a* provided in the lower sub die holder 22 and the upper sub holder 32 when viewed in front view.

<Structures of Lateral Grooves and Lead-Out Holes>

As shown in FIGS. 3 to 6, the lateral grooves 22*c* and 32*c* are grooves in which the lead wires 5*e* of the resistance heaters 51 and 52 and the lead wires 6*a* of the temperature sensors 61 and 62 are routed in bundled states, and formed to be orthogonal to the respective heater mounting holes 22*a* and 32*a*. That is, the lateral grooves 22*c* and 32*c* are formed to extend in the left-to-right direction from the larger diameter portions 22*a*1 and 32*a*1 of the heater mounting holes 22*a* and 32*a* disposed at the rightmost positions to the larger-diameter portions 22*a*1 and 32*a*1 of the heater mounting holes 22*a* and 32*a* disposed at the leftmost positions when viewed in plan view.

The lead-out holes 22*d* and 32*d* are for leading the lead wires 5*e* disposed in the lateral holes 22*c* and 32*c* to the outside of the lower sub die holder 22 and the upper sub die holder 32, and are formed to extend in the front-to-rear direction from the left end portions of the foregoing lateral grooves 22*c* and 32*c* to the front surface portions of the lower sub die holder 22 and the upper sub die holder 32.

<Structures of Holder Surfaces>

As shown in FIG. 1, the holder surfaces 22*e* and 32*e* are upper and lower surfaces which support the respective back surfaces 4*d* of the lower die 41 and the upper die 42 and to which the lower guide portions 23 and the upper guide portions 33 are fixed. That is, the holder surface 22*e* is the upper surface of the lower sub die holder 22 and, on the middle portion thereof, the lower die 41 is fixedly mounted while, on the left and right end portions thereof, the lower guide portions 23 are fixedly mounted. The holder surface 32*e* is the lower surface of the upper sub die holder 32 and, on the middle portion thereof, the upper die 42 is fixedly mounted while, on the left and right end portions thereof, the upper guide portions 33 are fixedly mounted. Between the lower guide portions 23 of the holder surface 22*e* and between the upper guide portions 33 of the holder surface 32*e*, the busting step dies 43, the blocking step dies 44, and the finishing step dies 34 are juxtaposed in the lateral direction.

<<Structures of Resistance Heaters>

As shown in FIGS. 3 and 4, the resistance heaters 51 and 52 are heating elements for heating the lower die holder 2 and the upper die holder to appropriate temperatures so as to prevent the forging raw material W from heat seizing to the dies 43, 44, and 45, or preheat or maintain the lower die 41 and the upper die 42 to be subjected to warm forging or hot forging to or at appropriate temperatures. The resistance heaters 5 are removably inserted into the plurality of heater mounting holes 22*a* and 32*a*, and each formed of a generally rod-shaped multi-cell heater in which the plurality of elongated heaters 5*a*, 5*b*, 5*c*, and 5*d* are connected in the longitudinal direction.

Figure 7:
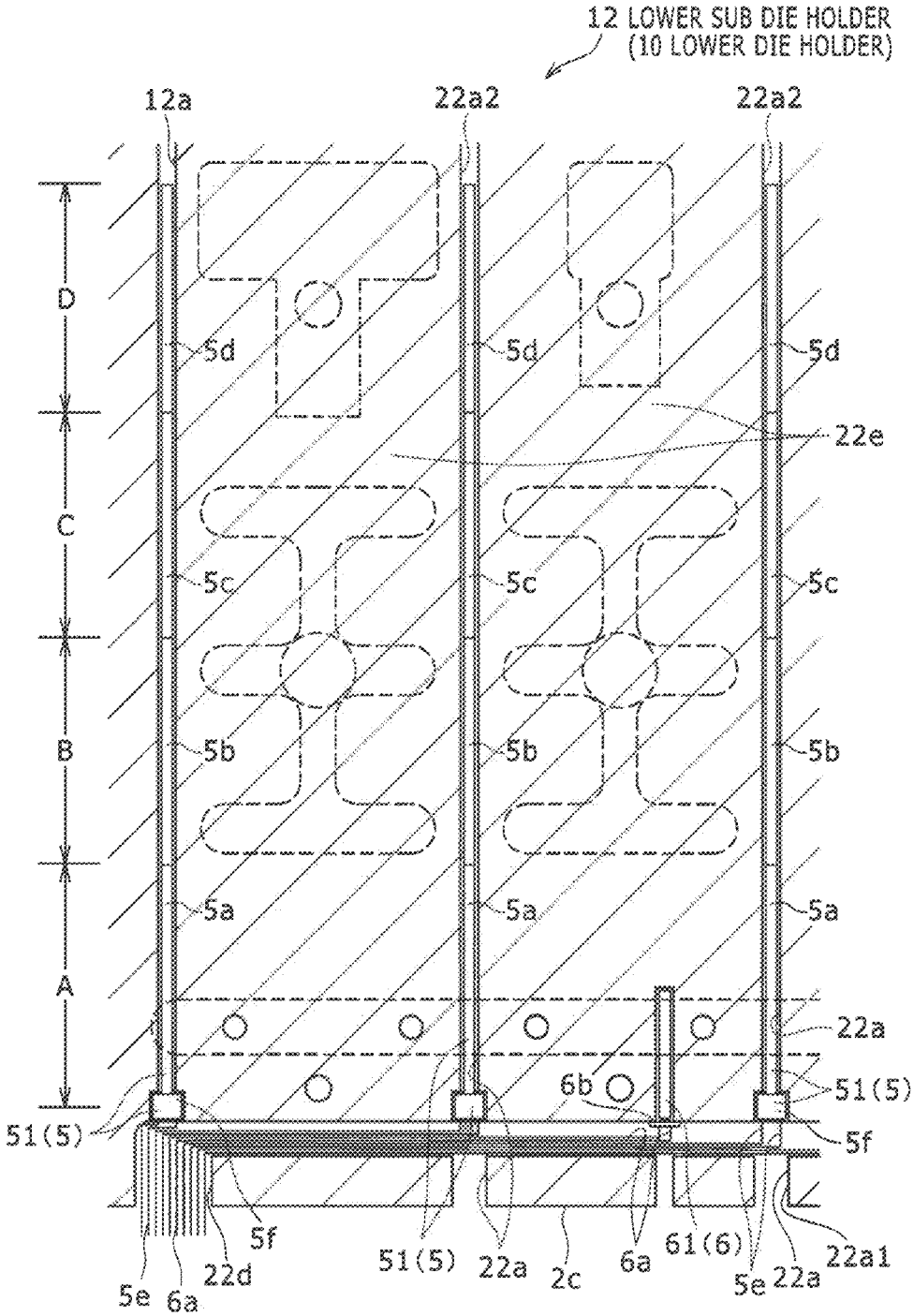
FIG. 7 is a main-portion enlarged cross-sectional view showing the state of mounting of the resistance heaters inserted in heater mounting holes of the lower sub die holder of the forging die holder according to the embodiment of the present invention.

As shown in FIG. 7, each of the resistance heaters 5 includes the plurality of independent heaters 5*a* to 5*d*, the pole disc 5*f* having connection terminals (not shown) and made of an insulator, a conductive wire (not shown) having one end connected to each of the heaters 5*a* to 5*d* and the other end connected to the connection terminal of the pole disc 5*f*, and the lead wire 5*e* having one end connected to the connection terminal of the pole disc 5*f* and the other end connected to a control device (not shown) for controlling the temperature of each of the heaters 5*a* to 5*d* based on the temperatures measured by the temperature sensors 61 and 62.

The heaters 5*a* to 5*d* are each formed into a cylindrical shape, formed linearly continuous from the pole disc 5*f*, and provided so as to share the task of heating zones A to D into which the lower sub die holder 22 the upper sub die holder 32 are partitioned.

The heaters 5*a* are disposed so as to undertake the task of heating the zones A of the lower sub die holder 22 and the upper sub die holder 32. The heaters 5*b* are disposed so as to undertake the task of heating the zones B of the lower sub die holder 22 and the upper sub die holder 32. The heaters 5*c* are disposed so as to undertake the task of heating the zones C of the lower sub die holder 22 and the upper sub die holder 32. The heaters 5*d* are disposed so as to undertake the task of heating the zones D of the lower sub die holder 22 and the upper sub die holder 32.

Accordingly, the control device (not shown) for controlling the resistance heaters 5 is capable of zone control under which the lower sub die holder 22 and the upper sub die holder 32 are partitioned into the zones, and heated to appropriate temperatures suited to the individual zones resulting from the partition.

The lead wires 5*e* provided in the individual resistance heaters 5 are led to the outside of the die holder 1 via the foregoing lateral grooves 22*c* and 32*c*, and wired.

<<Structures of Temperature Sensors>>

As shown in FIGS. 3 and 4, the temperature sensors 61 and 62 are thermometers for detecting the temperatures of the lower sub die holder 22 and the upper sub die holder 32, and sending detection signals to the control device (not shown), each of which is formed of, e.g., a thermocouple thermometer formed in a generally rod-like shape. To the pole discs 6*b* (see FIG. 7) of the temperature sensors 61 and 62, the lead wires 6*a* for connection to the control device (not shown) are connected.

The lead wires 6*a* are led together with the lead wires 5*e* of the foregoing resistance heaters 5 to the outside of the lower sub die holder 22 and the upper sub die holder 32 through the lateral grooves 22*c* and 32*c* and the lead-out holes 22*d* and 32*d*.

<<Structures of Lower Guide Portions and Upper Guide Portions>>

As shown in FIG. 1, the lower guide portions 23 and the upper guide portions 33 are disposed on the both end portions of the holder surfaces 22*e* and 32*e* such that the support surfaces 23*a* and 33*a* thereof support the both side surfaces 4*a* and 4*b* of the lower die 41 and the upper die 42 located therebetween from outside thereof in the left-to-right direction. The lower guide portions 23 and the upper guide portions 33 are formed of respective pairs of members provided on the both left and right end portions 2*b* of the upper surface of the lower sub die holder 22 and on the both left and right end portions 3*b* of the lower surface of the upper sub die holder 32 to extend in the front-to-rear direction.

<<Structures of Cover Members>>

As shown in FIG. 2, the cover members 24 and 34 are plate members connected by bolting to the front surfaces 2*c* and 3*c* and the rear surfaces 2*d* and 3*d* of the lower die holder 2 and the upper die holder 3, which include the front covers 24*a* and 34*a*, the rear covers 24*b* and 34*b*, and the lid plates 24*c* and 34*c*. Preferably, the cover members 24 and 34 are each formed of an insulating heat insulator material having a thick plate shape.

The front covers 24*a* and 34*a* are thick plate members disposed on the front surfaces 2*c* and 3*c* of the lower die holder 2 and the upper die holder 3 so as to cover the resistance heaters 51 and 52 inserted in the heater mounting holes 22*a* and 32*a* and the temperature sensors 61 and 62 inserted in the sensor mounting holes 22*b* and 32*b*.

The rear covers 24*b* and 34*b* are thick plate members disposed on the rear surfaces 2*d* and 3*d* of the lower die holder 2 and the upper die holder 3 so as to cover the resistance heaters 51 and 52 inserted in the heater mounting holes 22*a* and 32*a* and the lid plates 24*c* and 34*c*.

The lid plates 24*c* and 34*c* are thick plate members disposed on the middle portions of the rear surfaces 2*d* and 3*d* of the lower die holder 2 and the upper die holder 3 so as to close the heater mounting holes 22*a* and 32*a* formed closer to the middle portions of the rear surfaces 2*d* and 3*d* of the lower sub die holder 22 and the upper sub die holder 32.

<<Operation of Forging Die Holder>>

Next, the operation of the forging die holder according to the embodiment of the present invention will be described in order of the steps of manufacturing the forging raw material W.

<<Step of Heating Forging Raw Material>>

First, the heating step of placing the forging raw material W shown in FIG. 1 that has been cut into a specified preset size into a heating furnace (not shown), and preheating the forging raw material W to an optimum temperature for performing warm forging or hot forging.

<<Step of Heating Die Holder>>

Before the forging raw material W is set in the lower die 41, the lower die holder 2 and the upper die holder 3 are heated to an appropriate temperature for performing warm forging or hot forging with the resistance heaters 51 and 52 to be preheated. In this case, since the individual resistance heaters 51 and 52 are provided to extend in the longitudinal direction in the lower sub die holder 22 and the upper sub die holder 32 and between the three pairs of dies 4 that are the busting step dies 43, the blocking step dies 44, and the finishing step dies 45 in aligned relation with the side surfaces 4*a* and 4*b* of the plurality of dies 4 as shown in FIGS. 1 and 2, the whole lower and upper die holders 2 and 3 in which the dies 4 are held can be efficiently heated to a uniform temperature.

As shown FIG. 7, the heaters 5*a* to 5*d* of the resistance heaters 51 and 52 are individually disposed in the zones A to D into which the lower die holder 2 and the upper die holder 3 are partitioned, the independently controlled heaters 5*a* to 5*d* are adjusted to respective optimum heating temperatures by the control device (not shown) based on the temperatures detected by the temperature sensors 61 and 62 inserted into the lower die holder 2 and the upper die holder 3. Therefore, it is possible to efficiently and uniformly heat the whole lower and upper die holders 2 and 3.

In addition, as shown in FIG. 1, all the resistance heaters 51 and 52 are disposed at positions closer to the middle portions in relation to the left and right side surfaces of the lower guide portions 23 and the upper guide portions 33. Accordingly, the resistance heaters 51 and 52 are unlikely to be cooled by external members or the like, and located in the vicinity of the lower die 41 and the upper die 42. Therefore, the resistance heaters 51 and 52 can efficiently heat the die holder 1 and the dies 4 to desired set temperatures, and perform preheating or heat retention.

When heating is performed with the resistance heaters 51 and 52, the sensor mounting holes 22*b* and 32*b* into which the temperature sensors 61 and 62 are inserted can be disposed closer to the dies 4 than in the case where the temperature sensors 61 and 62 are disposed on the side surfaces of the die holder 1. Accordingly, the temperatures are transmitted faster due to the distance by which the temperature sensors 61 and 62 are disposed closer to the dies 4, and temperature measurement times are reduced, while the temperatures to or at which the dies 4 are heated or held can be precisely measured.

<<Warm Forging (Hot Forging) Step>>

Next, the preheated forging raw material W described above is set in the lower die 41 on the heated lower die holder 2 and, by downwardly moving the upper die 42 with the elevator (not shown), forging is performed. At that time, using the busting step dies 43, the busting step for the forging raw material W is performed first. Then, using the blocking step dies 44, the blocking step for the forging raw material W is performed. Thereafter, using the finishing step dies 45, the finishing step for the forging raw material W is performed, resulting in multi-step finishing.

As shown in FIG. 1, when warm forging or hot forging is performed, a press load (crushing load) resulting from downward pressing of the forging raw material W with the three upper dies 42 (the busting step die 43, the blocking step die 44, and the finishing step die 45) is placed on each of the dies 4. The total of eight resistance heaters 5 provided in the lower die holder 2 and the upper die holder 3 are all disposed in vertically aligned relation with the left and right side surfaces of the individual dies 4 to be laterally displaced from positions vertically under and over the forging raw material W in the lower sub die holder 22 and the upper sub die holder 32. Thus, the resistance heaters 5 can be disposed at positions where a press load lighter than the press load placed at positions immediately under and over the forging raw material W is placed on the resistance heaters 5. Therefore, damage or failure due to the press load can be reduced.

[Variations]

Note that the present invention is not limited to the embodiment described above, and various modifications and changes can be made within the scope of the technical concept thereof. It will be appreciated that the present invention also covers the modified and changed inventions.

For example, in the embodiment described above, the case has been described where each of the lower die 41 and the upper die 42 includes the three dies, which are the busting step die 43, the blocking step die 44, and the finishing step die 54. However, the number of the dies 4 is not particularly limited. That is, each of the lower die 41 and the upper die 42 may also include one die as long as it is held by the die holder 1. The number of the dies included in each of the lower die 41 and the upper die 42 may be increased or decreased in accordance with the number of forging press steps.

The case has also been described where the die holder 1 includes the lower die holder 2 including the lower main die holder 21, the lower sub die holder 22, and the lower guide portions 23 and the upper die holder 3 including the upper main die holder 31, the upper sub die holder 32, and the upper guide portions 33. However, the present invention is not limited thereto. That is, the lower die holder 2 and the upper die holder 3 may also be integrated with each other as long as the lower die 41 and the upper die 42 are held therein. Alternatively, each of the lower die holder 2 and the upper die holder 3 may also be divided into an appropriate number of parts that are fixed with a fixing tool such as a bolt.

As an example of each of the resistance heaters 5, the multi-cell heater in which the plurality of heaters 5*a* to 5*d* are connected has been described, but the resistance heater 5 is not limited thereto. That is, the resistance heater 5 may also be formed of a single rod-like heater.

What is claimed is:

1. A forging die holder for holding a die used in a forging press for performing warm forging or hot forging, comprising:

a heater mounting hole into which a resistance heater is inserted;

a sensor mounting hole into which a temperature sensor is inserted; and guide portions disposed on both end portions of a holder surface of the holder for supporting a back surface of the die to support side surfaces of the die located therebetween on both sides thereof, wherein the heater mounting hole is formed at a position opposing the holder surface in aligned relation with the side surfaces of the die, and the side surfaces of the die extend on a plane that intersects a length of the heater mounting hole, the length extending from a front surface of the die holder to a rear surface thereof.

2. The forging die holder according to claim 1, wherein, on the holder surface, a plurality of the dies are juxtaposed, and the heater mounting hole is formed at a position that is in alignment with each of the side surfaces of the plurality of the dies.

3. The forging die holder according to claim 1 or 2, wherein the resistance heater is formed of a rod-like heater removably provided to extend in the heater mounting hole.

4. The forging die holder according to claim 3, wherein the resistance heater is formed of a multi-cell heater in which a plurality of heaters are connected in a longitudinal direction.

5. The forging die holder according to claim 2, wherein a plurality of the heater mounting holes are arranged in a vertical direction, and the resistance heater is inserted in each of the plurality of heater mounting holes.

6. The forging die holder according to claim 5, wherein the sensor mounting hole is disposed substantially in the middle of the plurality of provided heater mounting holes.

7. The forging die holder according to claim 5 or 6, wherein the die holder is formed with a lateral groove orthogonal to the plurality of heater mounting holes, the plurality of resistance heaters are provided with respective lead wires, and each of the lead wires is led to the outside of the die holder via the lateral groove, and wired.

8. The forging die holder according to claim 1, wherein the holder surface of the holder is disposed in between the side surfaces of the die and the heater mounting hole.

* * * * *